US009550375B2

(12) United States Patent
Yamada et al.

(10) Patent No.: US 9,550,375 B2
(45) Date of Patent: Jan. 24, 2017

(54) INKJET IMAGE FORMING APPARATUS

(71) Applicants: Masafumi Yamada, Kanagawa (JP); Takuma Nakamura, Kanagawa (JP); Tetsurou Sasamoto, Kanagawa (JP)

(72) Inventors: Masafumi Yamada, Kanagawa (JP); Takuma Nakamura, Kanagawa (JP); Tetsurou Sasamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/878,390

(22) Filed: Oct. 8, 2015

(65) Prior Publication Data

US 2016/0114600 A1 Apr. 28, 2016

(30) Foreign Application Priority Data

Oct. 22, 2014 (JP) ..... 2014-215324

(51) Int. Cl.
*B41J 11/00* (2006.01)
*B41J 13/00* (2006.01)

(52) U.S. Cl.
CPC ..... *B41J 11/002* (2013.01)

(58) Field of Classification Search
CPC ..... B41J 13/0009; B41J 11/002
See application file for complete search history.

(56) References Cited

U.S. PATENT DOCUMENTS

2003/0081227 A1* 5/2003 Williams ..... B41J 3/543 358/1.8
2009/0244236 A1* 10/2009 Houjou ..... B41J 11/002 347/102
2011/0069103 A1 3/2011 Makimoto
2012/0013671 A1 1/2012 Houjou
2015/0022601 A1 1/2015 Ohnishi

FOREIGN PATENT DOCUMENTS

EP 2 407 310 A2 1/2012
JP 6-278271 10/1994
JP 7-195683 8/1995
JP 2001-150784 6/2001
(Continued)

OTHER PUBLICATIONS

Extended European Search Report issued Mar. 22, 2016 in Patent Application No. 15188899.7.

*Primary Examiner* — Jason Uhlenhake
(74) *Attorney, Agent, or Firm* — Oblon, McClelland, Maier & Neustadt, L.L.P.

(57) ABSTRACT

An inkjet image forming apparatus is provided. The inkjet image forming apparatus includes a recording unit, a selection heater, a heater, and a processor. The recording unit forms an ink image on a recording medium being conveyed. The selection heater is disposed downstream from the recording unit relative to a direction of conveyance of the recording medium, and selectively heats the ink image formed on the recording medium. The heater is disposed downstream from the selection heater relative to the direction of conveyance of the recording medium, and heats the recording medium on which the ink image has been selectively heated. The processor controls the recording unit, the selection heater, and the heater, and sets an output of the selection heater in view of an occurrence of cockling on the recording medium.

14 Claims, 10 Drawing Sheets

(56) References Cited

FOREIGN PATENT DOCUMENTS

| | | |
|---|---|---|
| JP | 2004-276551 | 10/2004 |
| JP | 2010-197535 | 9/2010 |
| JP | 2015-003489 | 1/2015 |
| JP | 2015-074136 | 4/2015 |
| JP | 2015-129902 | 7/2015 |
| WO | WO 2013/133001 A1 | 9/2013 |

* cited by examiner

INKJET IMAGE FORMING APPARATUS

CROSS-REFERENCE TO RELATED APPLICATIONS

This patent application is based on and claims priority pursuant to 35 U.S.C. §119(a) to Japanese Patent Application No. 2014-215324, filed on Oct. 22, 2014, in the Japan Patent Office, the entire disclosure of which is hereby incorporated by reference herein.

BACKGROUND

Technical Field

The present disclosure relates to an inkjet image forming apparatus.

Description of the Related Art

An inkjet recording apparatus (or inkjet image forming apparatus) that forms an ink image on a recording medium and dries the recording medium on which the ink image is formed is known.

SUMMARY

In accordance with some embodiments of the present invention, an inkjet image forming apparatus is provided. The inkjet image forming apparatus includes a recording unit, a selection heater, a heater, and a processor. The recording unit forms an ink image on a recording medium being conveyed. The selection heater is disposed downstream from the recording unit relative to a direction of conveyance of the recording medium, and selectively heats the ink image formed on the recording medium. The heater is disposed downstream from the selection heater relative to the direction of conveyance of the recording medium, and heats the recording medium on which the ink image has been selectively heated. The processor controls the recording unit, the selection heater, and the heater, and sets an output of the selection heater in view of an occurrence of cockling on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
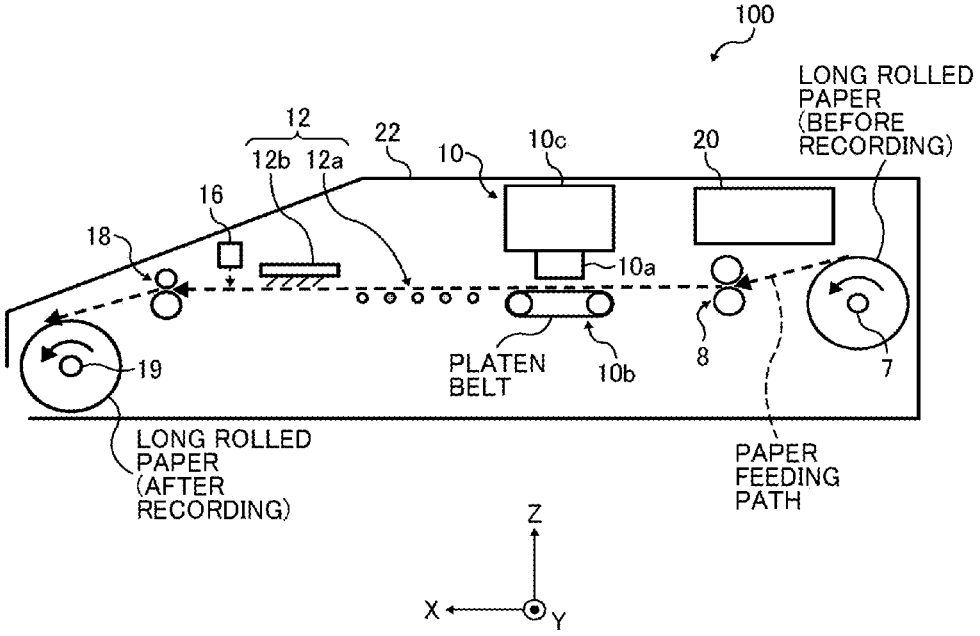
FIG. 1 is a schematic view of an inkjet image forming apparatus in accordance with an embodiment of the present invention.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

In accordance with some embodiments of the present invention, an inkjet image forming apparatus which provides an improved image quality is provided.

FIG. 1 is a schematic view of an inkjet image forming apparatus in accordance with an embodiment of the present invention.

An inkjet printer 100 includes a paper unwinder 7, a paper feeding roller pair 8, a recording unit 10, a dryer 12, a cockling condition detector 16, a paper ejection roller pair 18, a paper winder 19, a processor 20, and a housing 22 storing these units. Hereinafter, X-axis direction is defined as a direction of conveyance of recording paper (i.e., a horizontal single-axis direction), Y-axis direction is defined as a direction perpendicular to the X-axis direction on a horizontal plane, and Z-axis direction is defined as a direction perpendicular to both the X-axis and Y-axis directions (i.e., a vertical direction). In the present embodiment, long rolled paper is used as the recording paper.

The paper unwinder 7 deliverably holds the recording paper to a downstream side (i.e., +X side).

The paper feeding roller pair 8 is disposed on a downstream side (i.e., +X side) from the paper unwinder 7. The paper feeding roller pair 8 includes two rollers. The outer peripheral surfaces of the two rollers are contacting each other in the Y-axis direction to form a nip portion. The paper feeding roller pair 8 feeds the recording paper held by the paper unwinder 7 to a downstream side (i.e., +X side) while sandwiching the recording paper in the nip portion. Here, the direction of feed of the recording paper is coincident with the +X direction.

The recording unit 10 is disposed on a downstream side (i.e., +X side) from the paper feeding roller pair 8. The recording unit 10 includes an inkjet head 10*a*, a paper feeder 10*b*, and an ink cartridge 10*c*.

The inkjet head 10*a* is disposed on a +Z side relative to a part of paper feeding path extended from the paper feeding roller pair 8. The inkjet head 10*a* is supplied with an ink from the ink cartridge 10*c*. The inkjet head 10*a* may employ either a head mounted on a carriage that discharges ink while scanning in a width direction of the recording paper or a line head that discharges ink without scanning in a width direction of the recording paper.

The paper feeder 10*b* is disposed on a downstream side (i.e., +X side) from the paper feeding roller pair 8 and a −Z side relative to the inkjet head 10*a*. In other words, the paper feeder 10*b* is disposed facing the inkjet head 10*a*. The paper feeder 10*b* feeds the recording paper fed from the paper feeding roller pair 8 to a downstream side. The paper feeder 10*b* may include multiple rollers extending in the Y-axis direction, an endless platen belt stretched across the multiple rollers, and a suction unit for adsorptively holding the recording paper on the platen belt, such as an absorption fan.

In the recording unit 10, while the paper feeder 10*b* feeds the recording paper adsorptively held thereon to a downstream side, the inkjet head 10*a* discharges ink based on a driving signal transmitted from the processor 20 to form an ink image on the recording paper. The processor 20 generates a driving signal for driving the inkjet head 10*a* based on image data transmitted from a host device (e.g., personal computer), and outputs the driving signal to the recording unit 10.

The dryer 12 is disposed on a downstream side (i.e., +X side) from the recording unit 10. The dryer 12 dries the recording paper on which the ink image has been formed and swollen with the ink. Details of the dryer 12 are described later.

The cockling condition detector 16 is disposed on a downstream side (i.e., +X side) from the dryer 12. The cockling condition detector 16 detects a cockling condition of the recording paper having been dried with the dryer 12. Details of the cockling condition detector 16 are described later.

The paper ejection roller pair 18 is disposed on a downstream side (i.e., +X side) from the cockling condition detector 16. The paper ejection roller pair 18 includes two rollers. The outer peripheral surfaces of the two rollers are contacting each other in the Y-axis direction to form a nip portion. The paper ejection roller pair 18 feeds the recording paper having been dried by the dryer 12 to a downstream side while sandwiching the recording paper in the nip portion.

The paper winder 19 is disposed on a downstream side (i.e., +X side) from the paper ejection roller pair 18. The paper winder 19 winds the recording paper fed from the paper ejection roller pair 18.

The processor 20 performs overall control of the inkjet printer 100.

Generally, a dryer for drying ink-wetted recording paper is demanded by, for example, a high-speed printer in which a line head forms images on a rolled recording paper at a high speed and the recording paper is wound again, such as a line-head-type inkjet printer.

Since the line-head-type inkjet printer is capable of conveying recording paper at a constant speed, drying conditions by the dryer should be determined considering the linear speed thereof (i.e., the speed of conveying the recording paper).

In a case where a printed material needs a very long time to dry naturally, such as a case of drying a printed film, a dryer is also demanded even by a low-speed or middle-speed carriage-type inkjet printer.

The dryer 12 includes a dielectric heater 12*a* (serving as the selection heater) disposed on a downstream side (i.e., +X side) from the recording unit 10 and a uniform heater 12*b* (serving as the heater) disposed on a downstream side (i.e., +X side) from the dielectric heater 12*a*.

The uniform heater 12*b* nearly evenly heats the recording medium wetted with ink. The uniform heater 12*b* may employ conventional heating methods such as hot-air heating, heat drum, and wideband IR radiation heating represented by ceramic heating resistor.

Among these heating methods, wideband IR radiation heating is the best in terms of energy efficiency.

The dielectric heater 12*a* is a selection heater capable of selecting an object to be heated. The dielectric heater 12*a* may employ a microwave heating method or a high-frequency (1 to 100 MHz) dielectric heating method. The dielectric heater 12*a* generates heat by means of frictional heat caused by molecule vibration of a dielectric body. Therefore, calorific property of the dielectric heater 12*a* depends on the property of substance.

Calorific property of the dielectric heater 12*a* is represented by the following formula (1):

$$P(W/m^3)=0.556\times10^{-10}\times f\times E^2\times\in_r\times\tan\delta \quad (1)$$

wherein P ($W/m^3$) represents a calorific value per unit volume, f represents a frequency (Hz), E represents an electric field intensity (V/m), $\in_r$ represents a relative permittivity, and tan δ represents a dielectric loss tangent.

In the formula (1), $\in_r$ and tan δ vary depending on the type of substance. Water can easily generate heat because of having remarkably high $\in_r$ and tan δ values. In particular, water containing additives such as ion has greater $\in_r$ and tan δ values than pure water. This is a reason why the ink is easily heatable. By contrast, cellulose that composes paper generates little heat since a slight amount of moisture contained therein generates heat only slightly.

The dielectric heater 12*a* dries a part of the recording paper on which ink image is formed ("ink image part") but hardly dries another part of the recording paper on which no ink image is formed ("non-image part"). Thus, the dielectric heater 12*a* is capable of selectively heating an ink image formed on the recording paper.

Figure 2:
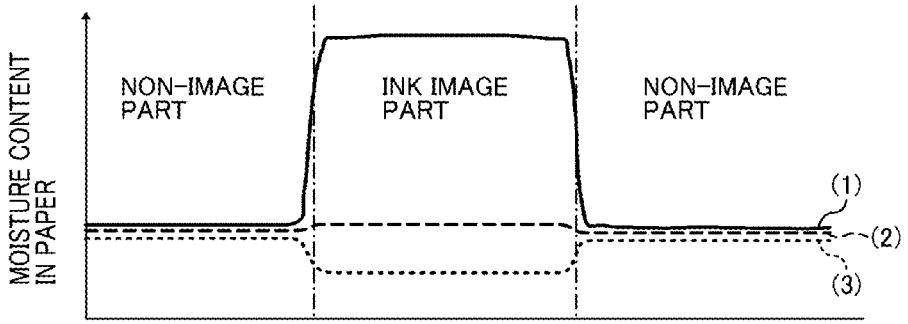
FIG. 2 is a graph showing a variation in moisture content between ink image part and non-image part when a dielectric heater is used.

As a result of selective heating by the dielectric heater 12*a*, the difference in moisture content between the ink image part and the non-image part becomes approximately zero as shown by dashed line (2) in FIG. 2. In a case where the output of the dielectric heater 12*a* is excessive, the reverse phenomenon occurs in which the ink image part more contracts than the non-image part, as shown by dotted line (3) in FIG. 2, to cause cockling on the non-image part. This indicates that no cockling occurs when the drying output (heating output) of the dielectric heater 12*a* is optimum as shown by dashed line (2) in FIG. 2.

In FIG. 2, solid line (1) shows a condition immediately after printing, dashed line (2) shows a drying condition which makes the amount of expansion or contraction of the ink image part zero, and dotted line (3) shows a drying condition with excessive drying energy.

On the other hand, inkjet ink generally contains solvents such as glycerin. Many of the solvents have a boiling point higher than that of water. Therefore, solvents will remain in the ink even when moisture has been evaporated therefrom. The remaining solvents may cause undesired phenomena such as offset and blocking. The occurrence of such phenomena indicates that the drying is insufficient.

To completely remove solvents from the ink, a larger amount of energy is required compared to a case of completely removing moisture from the ink. If the dielectric heater 12*a* generates a larger amount of energy to meet this requirement, the ink image part will more contract than the non-image part, as shown by dashed line (2) in FIG. 2, to cause cockling on the non-image part.

For the above reasons, the dryer 12 is composed of both the dielectric heater 12*a* (selection heater) and the uniform heater 12*b* to prevent the occurrence of cockling and to perform complete drying at the same time. First, the dielectric heater 12*a* provides an optimum drying output so that the difference in the amount of expansion or contraction between the ink image part and the non-image part becomes zero without causing cockling. Next, the uniform heater 12*b* provides an output until the solvents are completely removed, as shown by dotted line (3) in FIG. 3, while keeping the difference in the amount of expansion or contraction between the ink image part and the non-image part zero as shown in FIG. 4.

Figure 3:
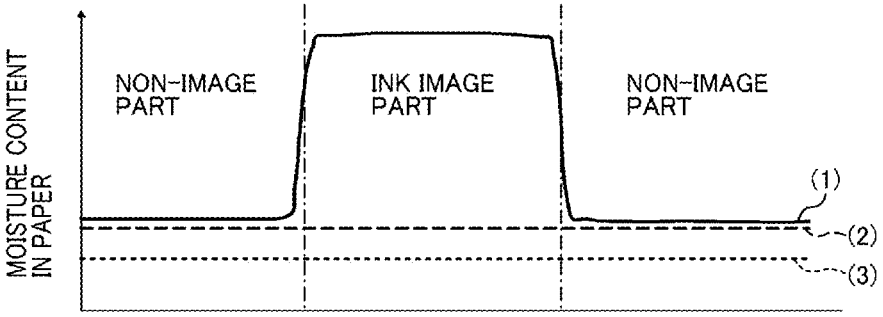
FIG. 3 is a graph showing a variation in moisture content between ink image part and non-image part when a dielectric heater and a uniform heater are used in combination.
Figure 4:
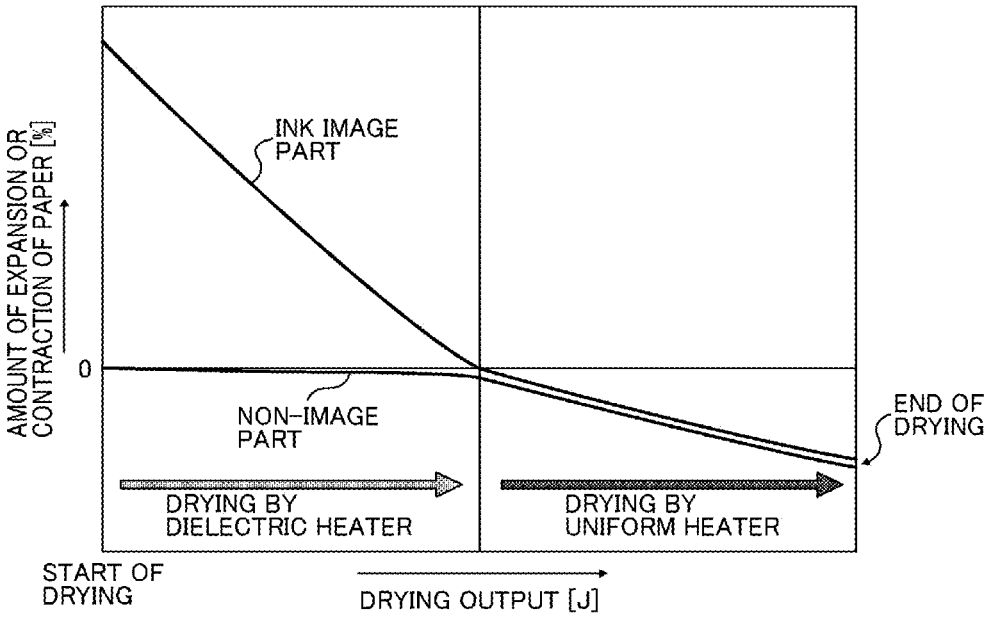
FIG. 4 is a graph showing a relation between drying output and the amount of expansion or contraction of paper when a dielectric heater and a uniform heater are used in combination.

In FIG. 3, solid line (1) shows a condition immediately after printing, dashed line (2) shows a drying condition by the dielectric heater, and dotted line (3) shows a drying condition by the uniform heater.

Figure 5:
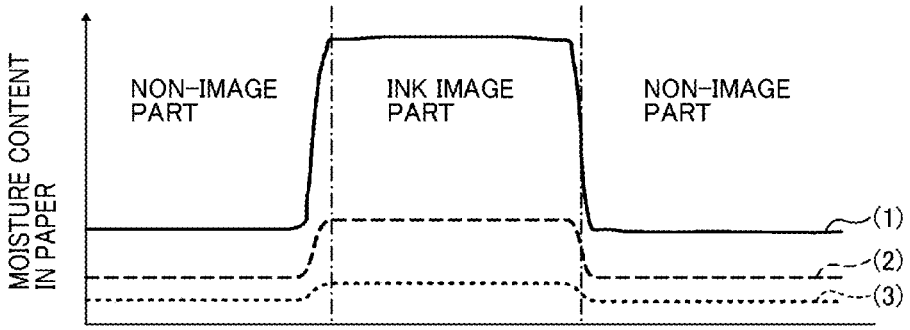
FIG. 5 is a graph showing a variation in moisture content between ink image part and non-image part when a uniform heater is used.

Comparison between FIGS. 2 and 5 shows that the uniform heater 12*b* (FIG. 5) is significantly less effective than the dielectric heater 12*a* in terms of drying. Therefore, performing dielectric heating prior to uniform heating for the purpose of preventing the occurrence of cockling also achieves energy saving in large amount.

In FIGS. 2 and 5, solid line (1) shows a condition immediately after printing, dashed line (2) shows a drying condition which makes the amount of expansion or contraction of the ink image part zero, and dotted line (3) shows a drying condition with excessive drying energy.

Figure 6:
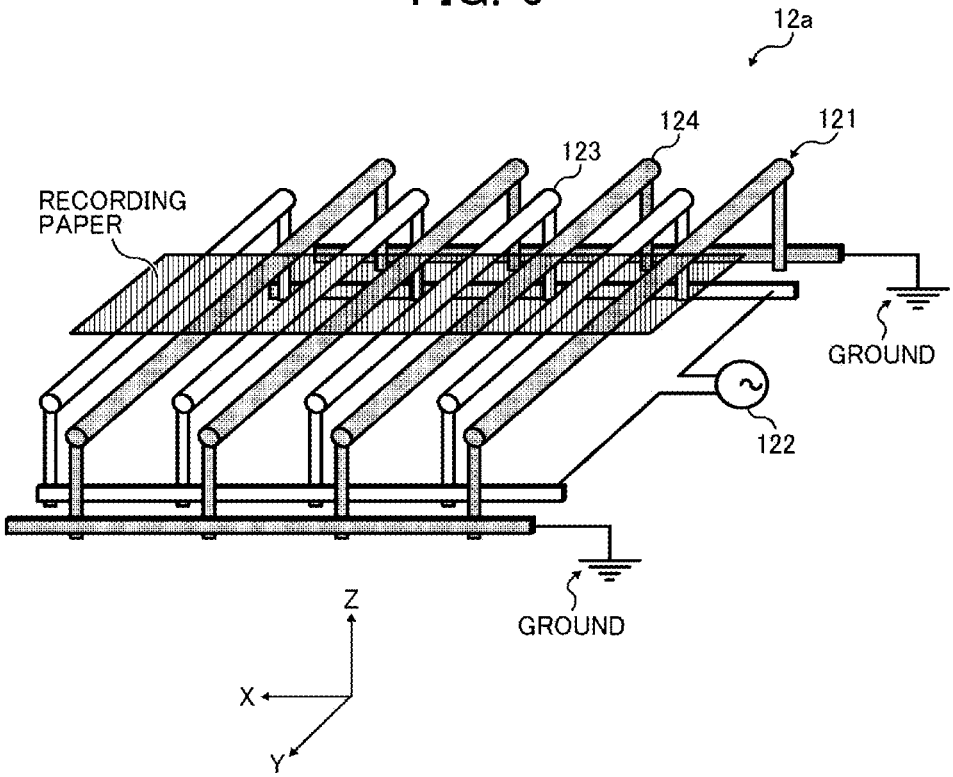
FIG. 6 is a schematic view of a dielectric heater in accordance with an embodiment of the present invention.

FIG. 6 is a schematic view illustrating a configuration of the dielectric heater 12*a*. Since the dielectric heater 12*a* has an opening for taking in/out the recording paper having ink image thereon to be dried/has been dried, a high-frequency wave having a frequency of 1 to 100 MHz is more suitable for dielectric heating than microwave, in view of leakage of radio wave from the opening. Additionally, dielectric heating using high-frequency wave is more advantageous in view of unevenness in heating. On the other hand, microwave is more advantageous in terms of power density.

In the present embodiment, the dielectric heater 12*a* employs a high-frequency dielectric heating method. The dielectric heater 12*a* heats only the ink image part on the recording paper without heating the non-image part thereon, thereby controlling the occurrence of cockling.

Within the above-specified frequency range of 1 to 100 MHz, around 13.56 MHz, 27.12 MHz, and 40.68 MHz are assigned as ISM (Industry-Science-Medical) bands. Therefore, the dielectric heater 12*a* uses one of these ISM bands.

The dielectric heater 12*a* includes a grid electrode 121 and a high-frequency power source 122.

The grid electrode 121 includes multiple application electrode parts 123 and multiple ground electrode parts 124 alternately arranged in the direction of conveyance of the recording paper (i.e., X-axis direction).

Each of the application electrode parts 123 is a rod-like electrode extending in the Y-axis direction. Both ends of each of the application electrode parts 123 are independently connected to respective poles of the high-frequency power source 122 to be applied with a high-frequency voltage. The high-frequency power source 122 is controlled by the processor 20. Therefore, the high-frequency voltage is controlled by the processor 20.

Each of the ground electrode parts 124 is a rod-like electrode extending in the Y-axis direction. Both ends of each of the ground electrode parts 124 are grounded. Alternatively, the ground electrode parts 124 may be applied with a high-frequency voltage having a 180°-inversed phase relative to the high-frequency voltage applied to the application electrode parts 123. Hereinafter, the application electrode parts 123 and the ground electrode parts 124 may be collectively referred to as "electrode parts".

Figure 7:
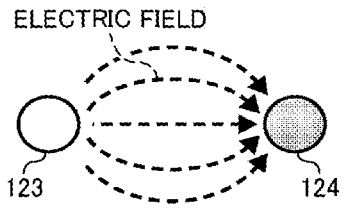
FIG. 7 is a partial schematic view of the dielectric heater illustrated in FIG. 6.

An electric field is formed between two adjacent electrode parts, as shown in FIG. 7. Hereinafter, two adjacent electrode parts may be referred to as "electrode pair".

Figure 8:
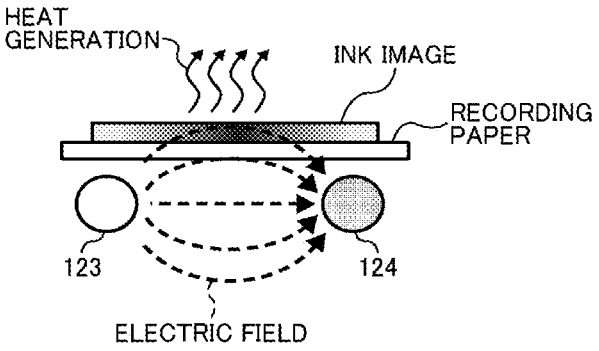
FIG. 8 is another partial schematic view of the dielectric heater illustrated in FIG. 6.

As the recording paper having the ink image thereon is positioned in the electric field, the ink image is heated, as shown in FIG. 8.

The configuration of electrode is not limited to that of the grid electrode 121 illustrated in FIG. 6 so long as an electric field can be generated. However, in the case of drying a thin sheet-like recording medium (or recording paper), the grid electrode 121 is preferably used because such a recording medium is most effectively dried as being conveyed along the grid electrode 121.

Since the electric field intensity increases toward the grid electrode 121, it is preferable that the recording paper is subjected to heating or drying while being brought as close as possible to the grid electrode 121.

Figure 9:
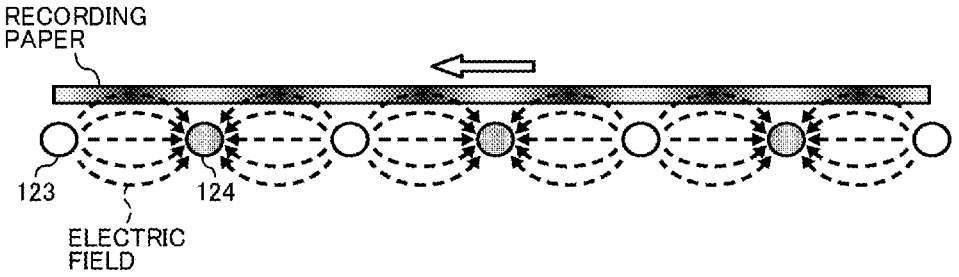
FIG. 9 is another partial schematic view of the dielectric heater illustrated in FIG. 6.

The field intensity gets strongest at the middle point between the electrode pair and weakest at a position immediately above each of the electrode parts, as shown in FIG. 9.

Such a configuration may cause uneven heating on the recording paper. However, in the case where the recording paper moves at a constant speed along the grid electrode 121, uneven heating may be hardly caused on the entire recording paper.

In the present embodiment, the interval between the electrode pairs in the grid electrode 121 is constant. In this case, the electric field intensity between the electrode pairs is also constant. Thus, the grid electrode 121 on the whole sufficiently prevents the occurrence of uneven heating.

The cockling condition detector 16 may employ various types of sensors such as a line-laser-type non-contact displacement sensor, a paper humidity sensor, and the like.

A line-laser-type non-contact displacement sensor 160 is described in detail below with reference to FIGS. 10A and 10B. The line-laser-type non-contact displacement sensor 160 includes a laser light emitting element 161 and an image sensor 162 (e.g., charge-coupled device (CCD) sensor, complementary metal-oxide semiconductor (CMOS) sensor).

Figure 10A:
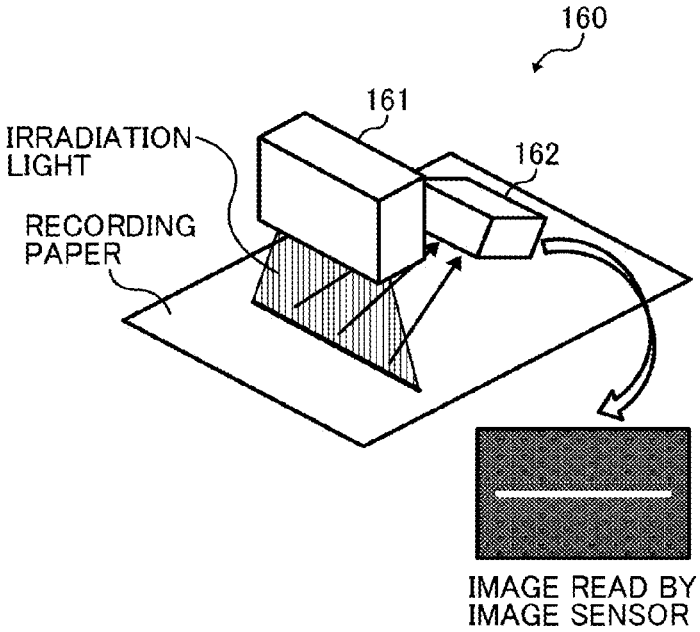
FIGS. 10A and 10B are schematic views of a line-laser-type non-contact displacement sensor in accordance with an embodiment of the present invention.
Figure 10B:
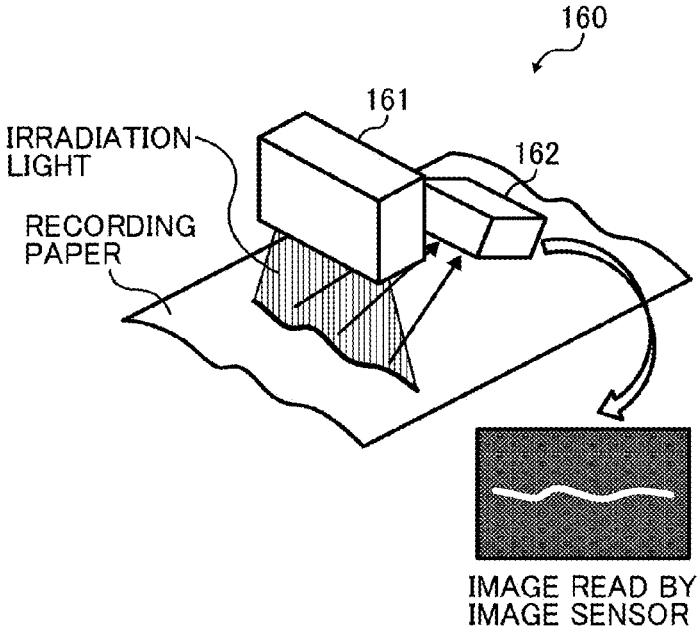

In the laser-type non-contact displacement sensor 160, the laser light emitting element 161 emits laser light having a line-like profile to the recording paper and the image sensor 162 receives light reflected from the recording paper, as shown in FIG. 10A.

The image sensor 162 is displaced from the laser light emitting element 161 in the direction of conveyance of the recording paper (i.e., X-axis direction). In the case where the recording paper has irregularity, the image sensor 162 reads the laser light emitted to the recording paper as a curve corresponding to the irregularity, as shown in FIG. 10B. Thus, cockling occurred on the recording paper can be detected. Although being generally expensive, the line-laser-type non-contact displacement sensor 160 is capable of directly detecting the occurrence of cockling with a high degree of accuracy.

In addition, a paper humidity sensor, such as a sensor described in JP-5212167-B, the disclosure thereof being incorporated herein by reference, may also be used as the cockling condition detector 16. The paper humidity sensor includes a compact heater, a compact thermometer, and a hygrometer, and detects moisture content in paper based on information from these components.

This is one example of MEMS (Micro Electro Mechanical Systems) technology which contributes to downsizing and low cost. Moreover, an infrared moisture meter, such as an instrument JE-700 available from Kett Electric Laboratory, may be used as the cockling condition detector 16, which causes a slight increase in cost.

Figure 11:
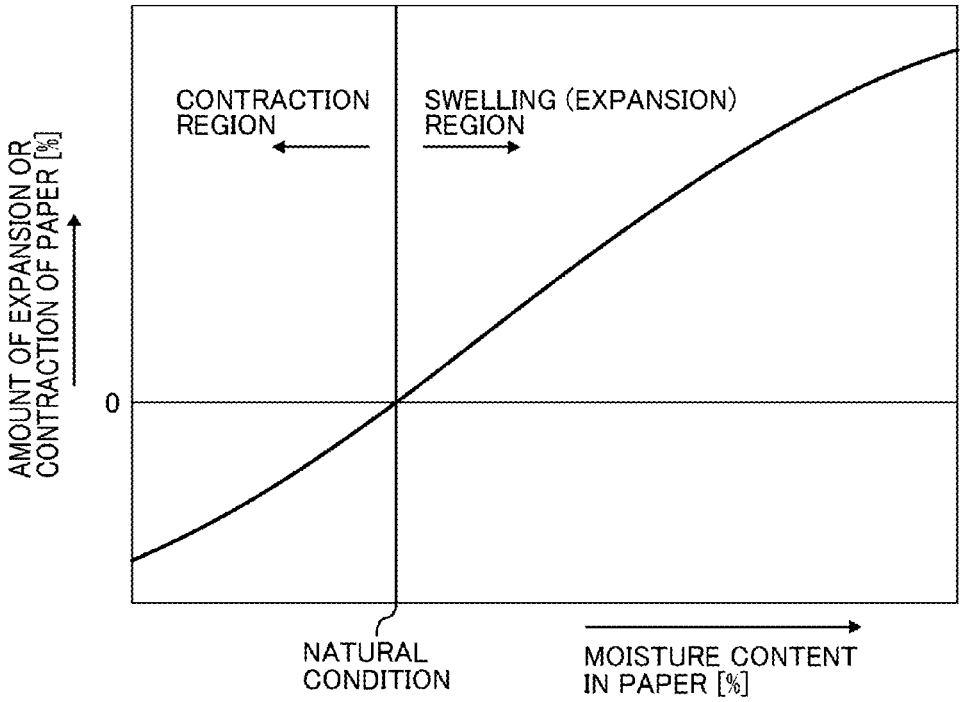
FIG. 11 is a graph showing a relation between moisture content in paper and the amount of expansion or contraction of the paper.

FIG. 11 shows a correlation between humidity of paper and the amount of cockling. The humidity of paper at which the amount of cockling becomes minimum may be measured and held in a table to be a target.

A mechanism of cockling is described below. Cockling is a phenomenon in which paper having an ink image thereon swells by moisture in the ink and becomes undulate. This phenomenon is caused due to a difference in the degree of swelling between the ink image part and the non-image part, which is generated because the ink image part is swollen by the ink but the peripheral non-image part is not.

FIG. 11 shows a relation between moisture content in paper and the amount of expansion or contraction of paper. Actually, paper starts swelling upon impact of an ink droplet thereon, and the swelling amount becomes maximum several tens of seconds later. Here, the maximum swelling amount is shown in FIG. 11.

As moisture in the ink permeates paper fiber to divide hydrogen bonds in the paper fiber, the paper generates swelling. Thus, the greater the moisture content in paper, the more the paper expands. Under natural condition, paper has a moisture content corresponding to atmospheric humidity. However, when the paper is forcibly dried, the moisture content in the paper decreases to cause contraction of the paper.

It is clear from FIG. 11 that as the amount of ink increases, the amount of swelling of paper and the amount of cockling also increase.

Figure 12A:
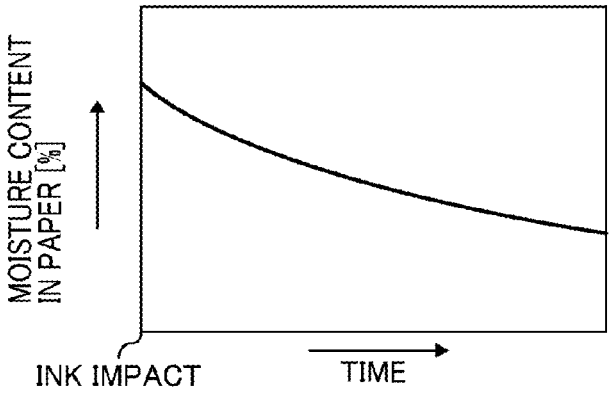
FIG. 12A is a graph showing a time variation of moisture content in paper under natural drying.

Referring to FIG. 12A, the moisture content in paper becomes maximum immediately after an ink impact and gradually decreases with time due to natural drying.

Figure 12B:
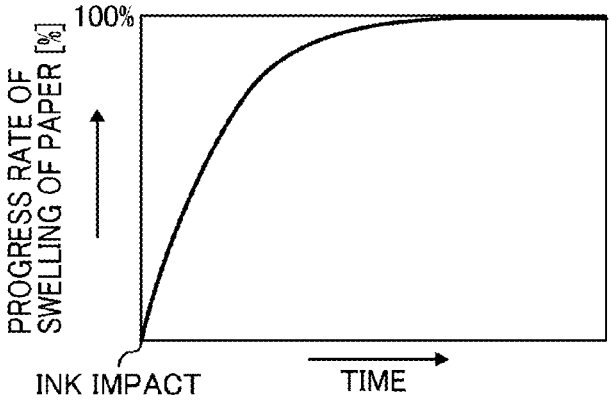
FIG. 12B is a graph showing a time variation of the progress rate of swelling of the paper after ink impact.
Figure 12C:
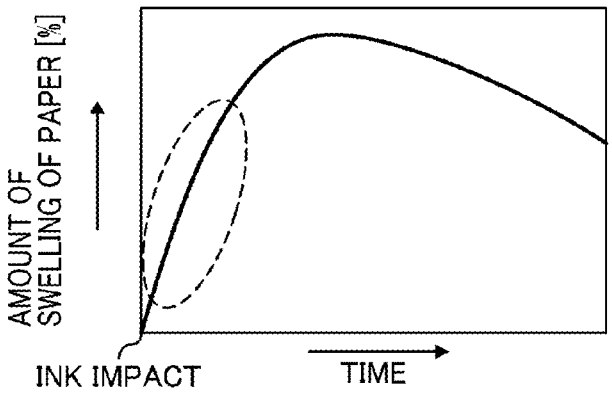
FIG. 12C is a graph showing a time variation of the amount of expansion or contraction of the paper after ink impact.

On the other hand, referring to FIG. 12B, it takes a certain period of time until the paper is swollen after the ink impact. An actual time variation of the amount of swelling of paper is shown in FIG. 12C. This graph is obtained for the product of the values on the vertical axis of the graph shown in FIG. 12A (i.e., moisture content in paper) and the synchronized values on the vertical axis of the graph shown in FIG. 12B (i.e., progress rate of swelling of paper).

According to the above-described mechanism, the swelling of paper should be canceled at the end of natural drying. However, the swelling of paper is not completely canceled in actual. The reason for this is considered that strain, which has been generated by dividing hydrogen bonds between paper fibers at generation of the swelling of paper, is still remaining.

Accordingly, in the case where the paper has experienced the condition in which the swelling amount of paper becomes maximum as shown in FIG. 12C, the residual strain also becomes larger. When the paper is subject to drying at the earliest possible timing, the paper needs not swell in large amounts. Therefore, the residual strain can be reduced and the quality of the dried output image can be improved. Thus, rapid drying is preferable.

Figure 13:
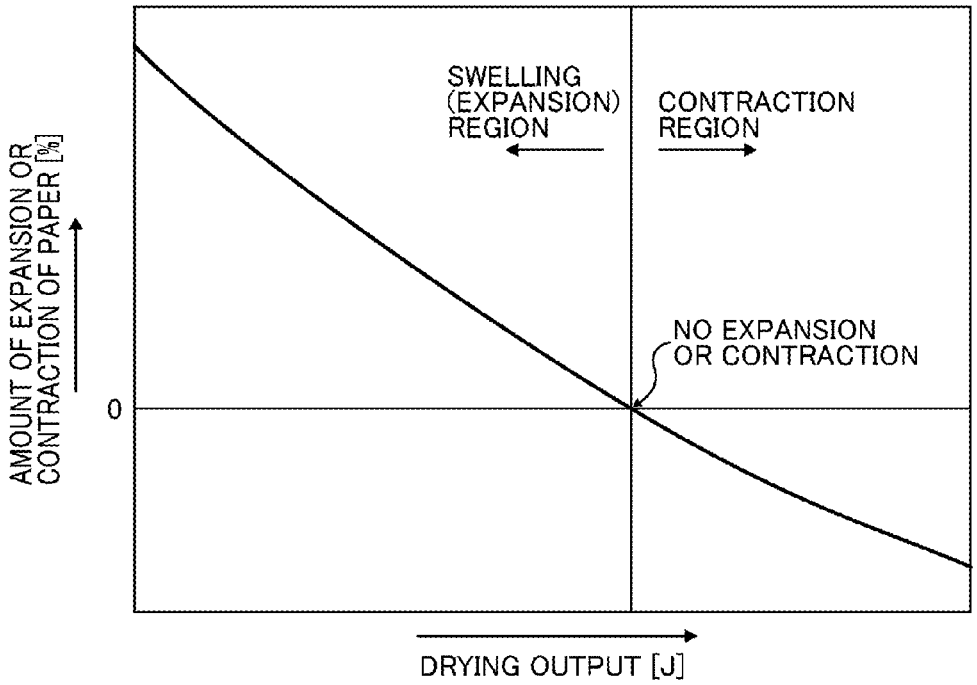
FIG. 13 is a graph showing a relation between drying output and the amount of expansion or contraction of paper.

A method of suppressing cockling by means of forced drying is described below. FIG. 13 shows a relation between drying output (J) in forcibly drying paper having an ink image thereon and the amount of expansion or contraction of the paper. It is clear from FIG. 13 that moisture in the ink is more evaporated as the drying output increases. Thus, the amount of expansion of paper decreases as the drying output increases, and the paper starts contracting at a specific drying output.

Accordingly, it is possible to suppress the paper from expanding or contracting by setting the drying output properly, i.e., in such a manner that the amount of expansion or contraction of the paper becomes zero. If a conventional heating method such as hot-air heating, heat drum, or wideband IR radiation heating represented by ceramic heating resistor is employed, the entire paper is uniformly heated. In this case, even when the amount of expansion or contraction of the ink image part becomes zero, the moisture content in the non-image part also decreases. As a result, the difference in moisture content between the ink image part and the non-image part becomes smaller but does not become zero, and therefore the amount of cockling does not becomes zero, as shown in FIG. 5.

How to specify and set the drying output using the cockling condition detector 16 is described below. As described above, one purpose of introducing the cockling condition detector 16 is to specify the optimum drying output of the dielectric heater 12*a*.

Cockling is likely to occur in solid image. Since the inkjet printer 100 (hereinafter simply "printer") not always outputs solid image and cockling needs a certain amount of time to grow, the drying output is preferably specified and set at the time of adjusting the inkjet printer 100. Accordingly, the process of specifying and setting the drying output may be performed by the processor 20 at the time of starting the printer or specific time intervals.

Figure 14:
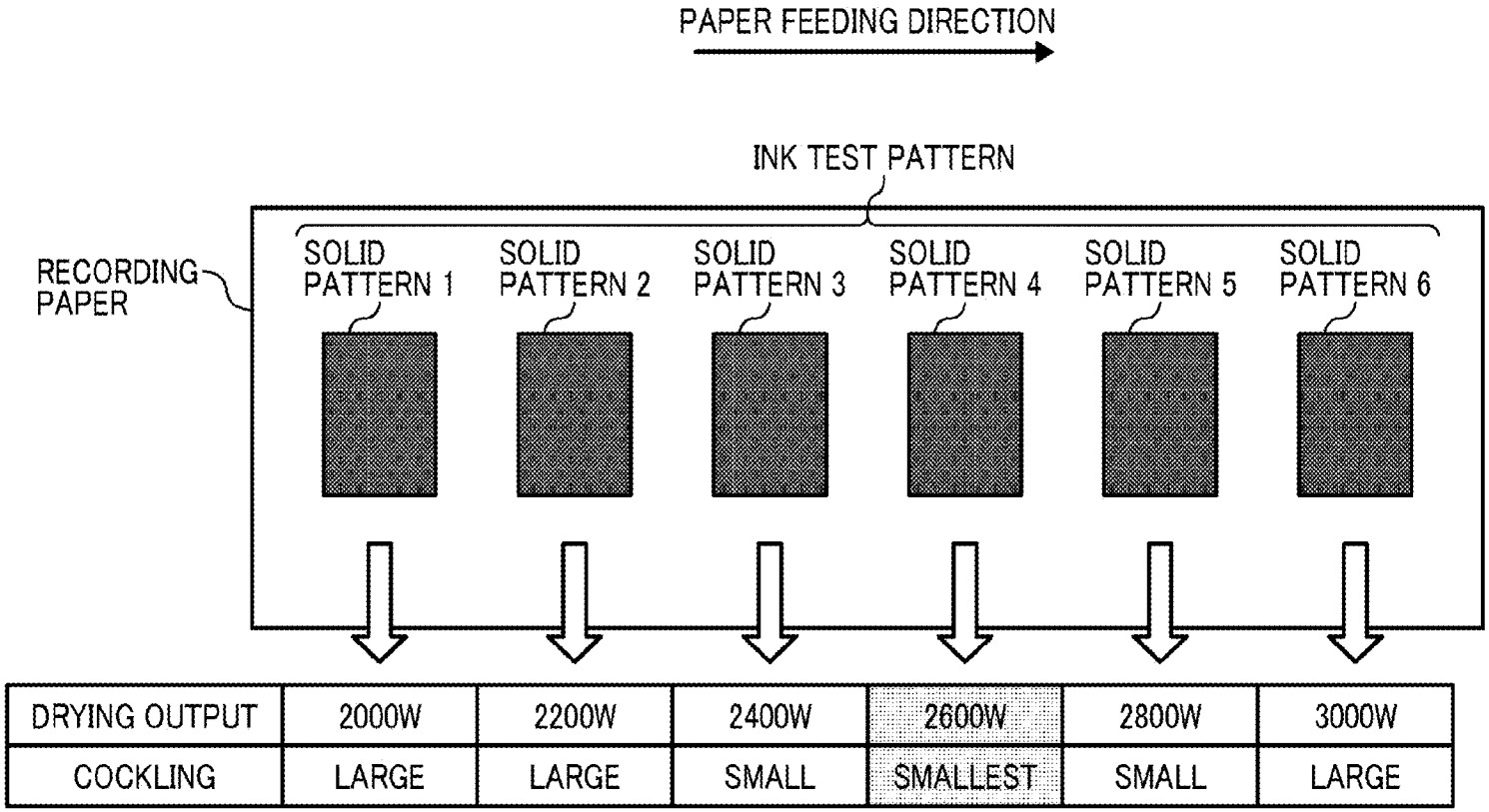
FIG. 14 is an illustration for explaining a process of specifying and setting drying output.

One example of the process of specifying and setting the drying output performed by the processor 20 is described below with reference to FIG. 14. First, an ink test pattern including multiple solid patterns (e.g., six solid patterns 1 to 6) arranged in the direction of conveyance of the recording paper (i.e., X-axis direction) is formed on the recording paper by the recording unit 10, as shown in FIG. 14. Each of the multiple solid patterns is sequentially heated by the dielectric heater 12*a* while varying the drying output pattern by pattern. At this time, the uniform heater 12*b* is not put into operation. Next, each of the solid patterns heated by the dielectric heater 12*a* is subjected to a measurement of the amount of cockling by the cockling condition detector 16. A drying output which provides the smallest amount of cockling is specified as the optimum drying output, as shown in FIG. 14. The specified drying output is set as the drying output of the dielectric heater 12*a*.

Since cockling needs a certain amount of time to grow, it is preferable that the multiple solid patterns are guided to the cockling detecting position (i.e., the measurement position by the cockling condition detector 16) and let stand still to be subjected to the measurement of the amount of cockling.

By employing the drying output specified and set in the above-described manner, it is possible to create a condition in which heating by the dielectric heater 12*a* causes no cockling. Thus, the uniform heater 12*b* on a downstream side from the dielectric heater 12*a* can complete drying while remaining the amount of cockling zero.

The ink test pattern may include a single solid pattern elongated in the X-axis direction in place of the multiple solid patterns. In this case, in place of the multiple solid patterns, multiple portions on the solid pattern along the X-axis direction may be subjected to the process of specifying and setting the drying output.

The optimum drying output that makes the amount of cockling minimum (zero) varies depending on the type (e.g., material, thickness) of recording paper and the type of ink. Therefore, in the case where the type of recording paper or the type of ink is changed after the process of specifying and setting the drying output has been performed, it is preferable to perform the process again.

In particular, the process of specifying and setting the drying output may be performed again every time the processor 20 receives a notice that the type of recording paper has been changed from a paper type determination unit or a paper thickness determination unit. The paper type determination unit and the paper thickness determination unit may employ either automatic determination or manual determination by user.

Alternatively, the process of specifying and setting the drying output is performed again every time the processor 20 receives a notice that the type of ink has been changed from an ink type determination unit. The ink type determination unit may employ either automatic determination or manual determination by user.

Since the optimum drying output changes as the conveyance speed of the recording paper is changed, it is preferable to perform the process of specifying and setting the drying output every time the conveyance speed of the recording paper is changed.

For example, when the conveyance speed of the recording paper is increased N times, the drying output may be also increased N times, based on the idea of proportional relation. The idea of proportional relation is not necessarily required. When the conveyance speed of the recording paper is increased, the drying output may be simply increased. When the conveyance speed of the recording paper is decreased, the drying output may be simply decreased. In other words, the drying output may be changed so as to follow the change in the conveyance speed of the recording paper. In this case, the optimum drying output can be determined in accordance with the conveyance speed of the recording paper to achieve both reliable drying and energy saving.

In the present embodiment, as the processor 20 receives a print request from a host device (e.g., personal computer), the inkjet printer 100 drives the paper feeding roller pair 8 to feed the recording paper (long rolled paper) from the paper unwinder 7 to the recording unit 10. In the recording unit 10, while the paper feeder 10*b* feeds the recording paper adsorptively held thereon to a downstream side, the inkjet head 10*a* discharges ink to form an ink image on the recording paper. A printed portion on the recording paper where the ink image has been formed is then fed to a position where the recording paper faces the dielectric heater 12*a*, and the ink image is selectively heated by the dielectric heater 12*a* under the optimum drying output. The printed portion on the recording paper where the ink image has been selectively heated is then fed to a position where the recording paper faces the uniform heater 12*b*, and almost the entire area of the printed portion is uniformly heated by the uniform heater 12*b*. The printed portion is further fed downstream and wound by the paper winder 19. A series of the above-described operations is repeated for each printed portion to finally form a series of ink images on the recording paper.

In accordance with an embodiment of the present invention, as described above, the inkjet printer 100 includes the recording unit 10 to form an ink image on a recording paper (recording medium); a dielectric heater 12*a* (selection heater) disposed on a downstream side (i.e., +X side) from the recording unit 10 relative to the direction of conveyance of the recording paper to selectively heat the ink image formed on the recording paper; the uniform heater 12*b* (heater) disposed on a downstream side (i.e., +X side) from the dielectric heater 12*a* to heat the recording paper on which the ink image has been selectively heated; the processor 20 to control the recording unit 10, the dielectric heater 12*a*, and the uniform heater 12*b*, and to set an output (drying output) of the dielectric heater 12*a* in view of the occurrence of cockling on the recording paper.

After the dielectric heater 12*a* selectively heats the ink image on the recording paper with an output which may generate cockling, the uniform heater 12*b* uniformly heats the recording paper. Specifically, after the dielectric heater 12*a* sufficiently removes moisture from the ink image, the uniform heater 12*b* sufficiently removes solvents (e.g., glycerin) from the ink image without increasing the difference in moisture content between the ink image part and the non-image part (i.e., while maintaining the difference in moisture content between the ink image part and the non-image part at near zero). In case solvents remain in the ink image, offset and blocking may occur even if moisture has been sufficiently removed from the ink image.

Thus, the recording paper is sufficiently dried while suppressing the occurrence of cockling thereon.

Accordingly, the inkjet printer 100 can provide an improved image quality.

In particular, since the processor 20 sets the output of the dielectric heater 12*a* to a specific output which suppresses the occurrence of cockling (i.e., the optimum drying output), the occurrence of cockling on the recording paper is reliably suppressed.

The inkjet printer 100 further includes the cockling condition detector 16 disposed on a downstream side (i.e., +X side) from the dielectric heater 12*a* relative to the direction of conveyance of the recording paper to detect the cockling condition of the recording paper. The recording unit 10 forms an ink test pattern including multiple solid patterns (portions) arranged in the direction of conveyance of the recording paper (i.e., X-axis direction) on the recording paper. The dielectric heater 12*a* sequentially heats each of the multiple solid patterns while varying the output pattern by pattern. The cockling condition detector 16 detects cockling condition with respect to the parts of the recording paper on which the multiple solid patterns are formed. The processor 20 obtains the detection results from the cockling condition detector 16 and correlates the output of the dielectric heater 12*a* with the detection results from the cockling condition detector 16 to determine the specific output of the dielectric heater 12*a*.

Thus, the specific output can be rapidly and easily determined.

In the case where the processor 20 determines the specific output at the time of starting the inkjet printer 100, even if the use environment of the printer, the type of recording paper, the type of ink, and/or the conveyance speed of the recording paper have been changed from the previous use, the output of the dielectric heater 12*a* can be set to the optimum specific output and the occurrence of cockling is reliably suppressed. The optimum specific output may vary depending on variation in time, environment (e.g., temperature, humidity), or the like.

In addition, in the case where the processor 20 determines the specific output at regular intervals, even if the use environment of the printer, the type of recording paper, the type of ink, and/or the conveyance speed of the recording paper have been changed from the previous timing of determination of the specific output, the output of the dielectric heater 12*a* can be set to the optimum specific output and the occurrence of cockling is reliably suppressed.

In the case where the processor 20 redetermines the specific output as the type of recording paper is changed after the previous determination of the specific output, the output of the dielectric heater 12*a* can be set to a specific output in accordance with the type of recording paper. Thus, the occurrence of cockling can be suppressed regardless of the type of recording paper.

In the case where the processor 20 redetermines the specific output as the type of ink used for forming an ink image is changed after the previous determination of the specific output, the output of the dielectric heater 12*a* can be set to a specific output in accordance with the type of ink. Thus, the occurrence of cockling can be suppressed regardless of the type of ink.

In the case where the processor 20 redetermines the specific output as the conveyance speed of the recording paper is changed after the previous determination of the specific output, by acquiring the changed conveyance speed and changing the specific output so as to follow the change of the conveyance speed, the output of the dielectric heater 12*a* can be set to a specific output in accordance with the conveyance speed of the recording paper. Thus, the occurrence of cockling can be suppressed regardless of the conveyance speed of the recording paper.

In the case where the cockling condition detector 16 is a line-laser-type non-contact displacement sensor that detects irregularity profile of the recording paper, it is possible to detect the cockling condition with a high degree of accuracy.

In the case where the cockling condition detector 16 is a paper humidity sensor that detects humidity of the recording paper, it is possible to detect the cockling condition while achieving downsizing and low cost using, for example, MEMS technology.

In the case where the dielectric heater 12*a* is a dielectric heater using microwave or a high-frequency wave (with a band frequency ranging from 1 to 100 MHz) that selectively heats a high-dielectric loss dielectric body, it is possible to effectively drying the ink image only.

Since the uniform heater 12*b* nearly evenly gives thermal energy to the nearly entire area of the recording paper, the entire area of the recording paper can be evenly dried.

A drying method in accordance with an embodiment of the present invention includes: a selection heating step for selectively heating an ink image formed on the recording paper being conveyed; and a heating step for heating the recording paper on which the ink image has been selectively heated in the selection heating step. The selection heating step is performed in view of cockling which may occur on the recording paper.

Thus, the recording paper is sufficiently dried while suppressing the occurrence of cockling thereon.

Accordingly, the drying method can provide an improved image quality.

In particular, since the selection heating step is performed under a specific output which suppresses the occurrence of cockling (i.e., the optimum drying output), the occurrence of cockling on the recording paper is reliably suppressed.

The drying method further includes the following steps prior to the selection heating step: a step of forming an ink test pattern including multiple solid patterns (portions) arranged in the direction of conveyance of the recording paper (i.e., X-axis direction) on the recording paper; a step of selectively heating each of the multiple solid patterns while varying the output pattern by pattern; a step of detecting cockling condition of the parts of the recording paper on which the multiple solid patterns are formed; and a step of determining the specific output by correlating the output in the selection heating and the cockling condition.

Thus, the specific output can be rapidly and easily determined.

Figure 15:
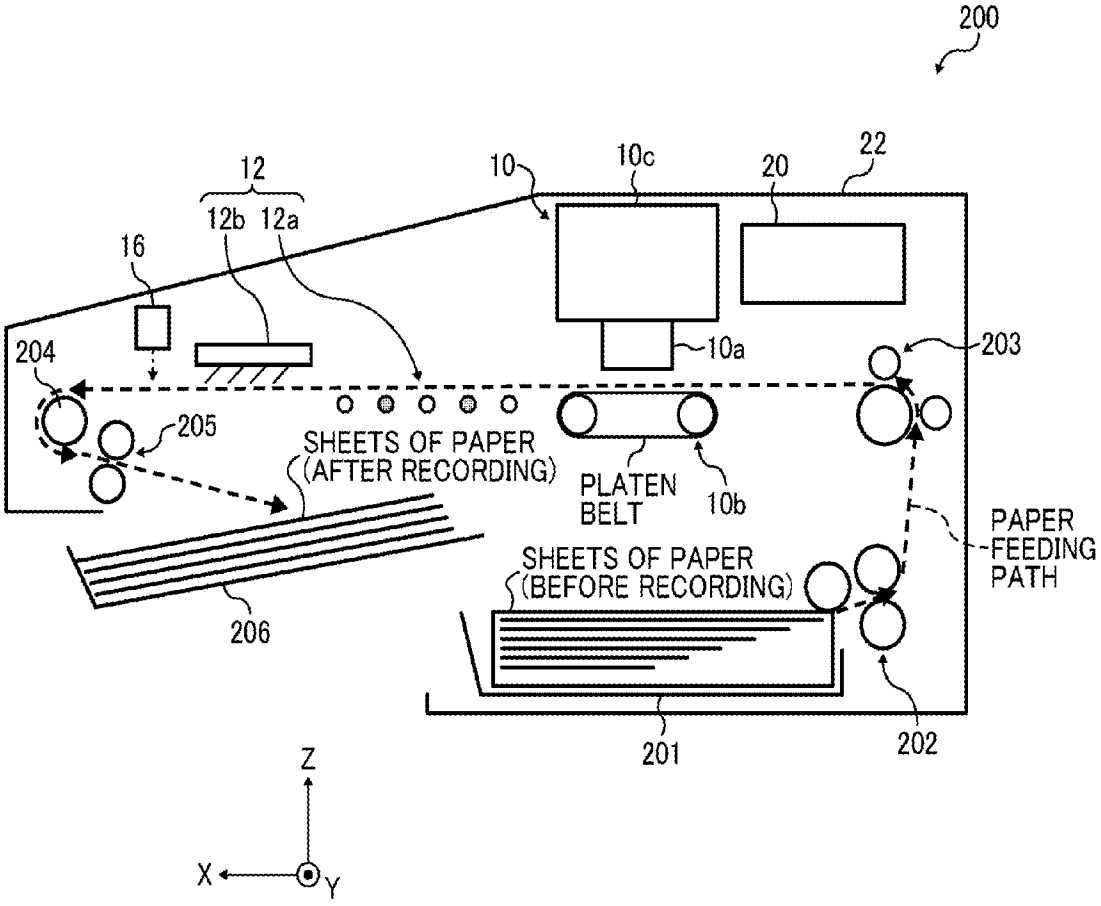
FIG. 15 is a schematic view of an inkjet image forming apparatus in accordance with another embodiment of the present invention.

FIG. 15 is a schematic view of an inkjet image forming apparatus in accordance with another embodiment (Modification 1) of the present invention. An inkjet printer 200 is configured to be compatible with a recording paper in the form of sheet.

The inkjet printer 200 includes a paper feeding tray 201 to stack a recording paper in the form of sheet, a paper feeding roller group 202 to take out the recording paper from the paper feeding tray 201 sheet by sheet, a registration roller group 203 disposed downstream from the paper feeding roller group 202, a recording unit 10 disposed downstream from the registration roller group 203, a dryer 12 disposed downstream from the recording unit 10, a cockling condition detector 16 disposed downstream from the dryer 12, a folding roller 204 disposed downstream from the cockling condition detector 16, a paper ejection roller pair 205 disposed downstream from the folding roller 204, and a paper ejection tray 206 disposed downstream from the paper ejection roller pair 205.

The inkjet printer 200 according to Modification 1 can reliably dry recording paper while suppressing the occurrence of cockling thereon.

In this embodiment (Modification 1), the recording unit 10 forms an ink test pattern including multiple solid patterns (portions) arranged in the direction of conveyance of the recording paper (i.e., X-axis direction) on the recording paper (in the form of sheet). The dielectric heater 12*a* sequentially heats each of the multiple solid patterns while varying the output pattern by pattern. The cockling condition detector 16 detects cockling condition of the parts of the recording paper on which the multiple solid patterns are formed. The processor 20 correlates the output of the dielectric heater 12*a* with the detection results from the cockling condition detector 16 to determine the specific output of the dielectric heater 12*a*.

In an inkjet image forming apparatus according to another embodiment (Modification 2) of the present invention, a cycle including the steps of forming an ink test pattern (e.g., solid pattern) on the recording paper (in the form of sheet) by the recording unit 10, heating the ink test pattern by the dielectric heater 12*a*, and detecting cockling condition of the part of the recording paper on which the ink test pattern is formed by the cockling condition detector 16, is repeated multiple times while varying the output of the dielectric heater 12*a* every time. The processor 20 correlates the output of the dielectric heater 12*a* for every cycle with the detection results from the cockling condition detector 16 to determine the specific output of the dielectric heater 12*a*.

A drying method according to this embodiment (Modification 2) includes the following steps prior to the selection heating step: a step of repeating multiple times a cycle including the steps of forming an ink test pattern (e.g., solid pattern) on the recording paper (in the form of sheet), selectively heating the ink test pattern, and detecting cockling condition of the part of the recording paper on which the ink test pattern is formed, while varying the output for selective heating every time; and a step of determining the specific output by correlating the output for every cycle and the cockling condition.

In the inkjet printer and drying method according to Modification 2, the cycle including the steps of forming an ink test pattern (e.g., solid pattern) on the recording paper (in the form of sheet), selectively heating the ink test pattern, and detecting cockling condition of the part of the recording paper on which the ink test pattern is formed, is repeated while varying the output for selective heating every time. Namely, in Modification 2, multiple sheets of the recording paper, on one part of each of which the ink test pattern is formed, are subjected to detection of condition of cockling. In this case, it is possible to detect condition of cockling with a high degree of accuracy, and therefore it is possible to determine the specific output with a high degree of accuracy. In Modification 2, an ink pattern is formed on one part of each sheet of the recording paper, and multiple sheets of the recording paper, on one part of each of which the ink test pattern is formed, are subjected to detection of condition of cockling. Alternatively, it is possible that an ink pattern (e.g., solid pattern) is formed on multiple parts of each sheet of the recording paper, each of the multiple parts are selectively heated to be dried with a different output, and the multiple parts of the multiple sheets are subjected to detection of condition of cockling.

In the case of detecting cockling condition of multiple parts of one sheet of the recording paper, there is a possibility that the cockling condition interferes with one another between different parts. Therefore, it is preferable that the interval between two adjacent parts of the recording paper is large enough to avoid the interference.

In Modification 2, it is preferable that both the ink test pattern (e.g., solid pattern) and the sheet of the recording paper are as small as possible in size from the viewpoint of speeding up and energy saving.

In the above-described embodiments, the cockling condition detector 16 is disposed on a downstream side (i.e., +X side) from the uniform heater 12*b*. Alternatively, the cockling condition detector 16 may be disposed on an upstream side (i.e., −X side) from the uniform heater 12*b* and a downstream side from the dielectric heater 12*a*.

In the above-described embodiments, the ink image is formed based on image data transmitted from a personal computer or the like. Alternatively, the inkjet printer may have a scanner and the ink image may be formed based on image data read by the scanner.

The above-described embodiments have been conveyed by the inventors of the present invention based on the following thought process.

There is a growing need for small-lot multiproduct printing, for printing direct mails for individuals, etc., in recent years. Commercial offset printer is for large-lot printing using a printing plate. Such an offset printer becomes more advantageous in cost performance and efficiency as the number of print copies increases. However, offset printer is unsuitable for variable printing such as small-lot multiproduct printing. For variable printing, on-demand printing using no plate is suitable. High-speed on-demand printers employing electrophotography is now spreading.

Another example of the on-demand printing includes inkjet printing. Since inkjet printing system is simpler than electrophotography, compact and budget personal inkjet printer is in widespread use. However, high-speed inkjet printer has not been actively developed in view of reliability of ink nozzle and printing speed.

Recently, the development of line head has advanced. Since line head does not require main scanning of ink nozzle, it is now possible to develop high-speed inkjet printer. Accordingly, there is a strong possibility that high-definition inkjet printer with simple configuration is developed as on-demand high-speed printer.

Inkjet printer has some problems in a drying process. Low-speed printers for personal use have a problem of paper swelling caused due to moisture in ink. However, this problem is not fatal and can be solved by means of natural drying of the paper.

With respect to high-speed printers, this problem cannot be solved by natural drying. When the printed copies are stacked, undesired phenomena such as offset, blocking, and color omission.

Thus, the drying process cannot be eliminated. As the drying process, heat drum drying, radiation drying using halogen lamp or infrared heater, and hot-air drying have been employed.

The drying process in inkjet printer corresponds to the fixing process in electrophotography. Therefore, the drying process damages one merit of inkjet technology, i.e., low energy consumption. Thus, it is required that the amount of energy consumed in the drying process is as small as possible.

An object to be heated is only ink. If other parts such as paper or roller are heated, energy is consumed unnecessarily. To selectively heat ink, heating means using frictional loss of dipole of dielectric body may be used, such as microwave heating and high-frequency wave dielectric heating. In this case, the calorific value depends on dielectric constant and loss tangent of the dielectric body. These values for water are extremely high.

Accordingly, with respect to a medium on which an image is formed with an ink, the medium is not heated and only moisture in the ink is heated. Since only the amount of heat used for heating becomes power loss in a high-frequency electric field, it is overwhelmingly advantageous in energy efficiency.

Microwave band is greater than high-frequency wave band in terms of loss tangent of water. Thus, microwave band is more advantageous for high-energy-density heating. However, there are some problems such as radio wave leakage and uneven heating. When a printer configured to successively take in/out a medium employs a dryer using microwave, the configuration may become complicated and the cost may increase. By contrast, high-frequency dielectric heater is simpler in configuration, and has been widely used for print dryer.

Inkjet printing also has a problem of cockling. Cockling is a phenomenon in which paper having an ink image thereon swells by moisture in the ink and becomes undulate. In a case where a solid patch image is formed on paper, the solid image part is swollen by the ink but the peripheral non-image part is not. Cockling is caused due to a difference in the degree of swelling generated at an interface of the image. Actually, cockling starts growing upon impact of an ink droplet on paper, and the amount of cockling becomes maximum several tens of seconds later. The order of the amount of cockling corresponds to the time scale of permeation and swelling of paper fiber. The amount of cockling thereafter decreases by natural drying, however, does not become zero. This is because strain, which has been generated due to swelling of paper, is still remaining. With respect to high-quality printing such as offset printing, even a slight amount of cockling may degrade the image quality. Accordingly, how to suppress the occurrence of cockling is one object for inkjet printing that is one of high-quality printing.

What is claimed is:

1. An inkjet image forming apparatus, comprising:

a recording unit to form an ink image on a recording medium being conveyed;

a selection heater disposed downstream from the recording unit relative to a direction of conveyance of the recording medium, to selectively heat the ink image formed on the recording medium;

a heater disposed downstream from the selection heater relative to the direction of conveyance of the recording medium, to heat the recording medium on which the ink image has been selectively heated;

a detector to detect a cockling condition of the recording medium; and a processor to control the recording unit, the selection heater, and the heater, and to set an output of the selection heater based on a detection result from the detector.

2. The inkjet image forming apparatus according to claim 1, wherein the processor sets the output of the selection heater to a specific output which prevents the occurrence of cockling.

3. The inkjet image forming apparatus according to claim 2, wherein the detector is disposed downstream from the selection heater relative to the direction of conveyance of the recording medium, and wherein the processor correlates the output from the selection heater and the detection result from the detector to determine the specific output.

4. The inkjet image forming apparatus according to claim 3, wherein the detection result includes a plurality of detection results, each obtained by the detector with respect to a plurality of parts of the recording medium, on each of which an ink test pattern has been formed by the recording unit and has been heated by only the selection heater with a different output.

5. The inkjet image forming apparatus according to claim 3, wherein the processor determines the specific output at the time of starting the inkjet image forming apparatus.

6. The inkjet image forming apparatus according to claim 3, wherein the processor determines the specific output at regular intervals.

7. The inkjet image forming apparatus according to claim 3, wherein, when a type of the recording medium is changed after the specific output has been determined, the processor redetermines the specific output.

8. The inkjet image forming apparatus according to claim 3, wherein, when a type of an ink used for forming the ink image is changed after the specific output has been determined, the processor redetermines the specific output.

9. The inkjet image forming apparatus according to claim 3, wherein, a speed of conveying the recording medium is changed after the specific output has been determined, the processor redetermines the specific output so as to follow the change of the speed.

10. The inkjet image forming apparatus according to claim 3, wherein the detector is a line-laser-type non-contact displacement sensor that detects an irregularity profile of the recording medium.

11. The inkjet image forming apparatus according to claim 3, wherein the detector is a humidity sensor that detects humidity of the recording medium.

12. The inkjet image forming apparatus according to claim 1, wherein the selection heater is a dielectric heater employing a microwave or a high-frequency wave having a frequency in the range of 1 to 100 MHz that selectively heats a high-dielectric-loss dielectric body.

13. The inkjet image forming apparatus according to claim 1, wherein the heater is a uniform heater that nearly uniformly gives thermal energy to an almost entire area of the recording medium.

14. The inkjet image forming apparatus according to claim 1, wherein the selection heater is a dielectric heater that selectively heats a portion of the recording medium on which the ink image more than a portion of the recording medium on which no ink image is formed.

* * * * *